US010961856B2

(12) United States Patent
Paquin et al.

(10) Patent No.: US 10,961,856 B2
(45) Date of Patent: Mar. 30, 2021

(54) CERAMIC CORE FOR A MULTI-CAVITY TURBINE BLADE

(71) Applicants: SAFRAN, Paris (FR); SAFRAN AIRCRAFT ENGINES, Paris (FR)

(72) Inventors: Sylvain Paquin, Herblay (FR); Charlotte Marie Dujol, Moissy-Cramayel (FR); Patrice Eneau, Moissy-Cramayel (FR); Hugues Denis Joubert, Paris (FR); Adrien Bernard Vincent Rollinger, Joinville-le-Pont (FR)

(73) Assignees: SAFRAN AIRCRAFT ENGINES, Paris (FR); SAFRAN, Paris (FR)

( * ) Notice: Subject to any disclaimer, the term of this patent is extended or adjusted under 35 U.S.C. 154(b) by 230 days.

(21) Appl. No.: 15/560,234

(22) PCT Filed: Mar. 22, 2016

(86) PCT No.: PCT/FR2016/050628

§ 371 (c)(1),
(2) Date: Sep. 21, 2017

(87) PCT Pub. No.: WO2016/151234

PCT Pub. Date: Sep. 29, 2016

(65) Prior Publication Data

US 2018/0073373 A1 Mar. 15, 2018

(30) Foreign Application Priority Data

Mar. 23, 2015 (FR) ..... 1552383

(51) Int. Cl.
*F01D 5/28* (2006.01)
*F01D 5/18* (2006.01)
(Continued)

(52) U.S. Cl.
CPC ..... *F01D 5/284* (2013.01); *B22C 9/04* (2013.01); *B22C 9/10* (2013.01); *F01D 5/18* (2013.01);
(Continued)

(58) Field of Classification Search
CPC ... F01D 5/14; F01D 5/18; F01D 5/186; F01D 5/187; F01D 5/284; B22C 9/04;
(Continued)

(56) References Cited

U.S. PATENT DOCUMENTS 2,972,805 A * 2/1961 Turner ..... F01D 5/147 29/889.721
4,500,258 A * 2/1985 Dodd ..... F01D 5/187 416/96 R
(Continued)

FOREIGN PATENT DOCUMENTS

EP 1 306 147 A1 5/2003
EP 1 935 532 A1 6/2008
(Continued)

OTHER PUBLICATIONS

International Search Report dated Jun. 7, 2016 in PCT/FR2016/050628 filed Mar. 22, 2016.
(Continued)

*Primary Examiner* — Igor Kershteyn
*Assistant Examiner* — Wayne A Lambert
(74) *Attorney, Agent, or Firm* — Oblon, McClelland, Maier & Neustadt, L.L.P.

(57) ABSTRACT

A ceramic core used for fabricating a hollow turbine blade for a turbine engine by using the lost-wax casting technique and shaped to constitute the cavities of the blade as a single element, includes, in order to feed the insides of these cavities jointly with cooling air, core portions that are to form first and second lateral cavities and that are connected
(Continued)

to a core portion that is to form at least one central cavity, firstly in the core root via at least two ceramic junctions, and secondly at various heights up the core via a plurality of other ceramic junctions of positioning that defines the thickness of the internal partitions of the blade, while also ensuring additional cooling air for predetermined critical zones of the first and second lateral cavities.

8 Claims, 4 Drawing Sheets

(51) Int. Cl.
*B22C 9/10* (2006.01)
*B22C 9/04* (2006.01)

(52) U.S. Cl.
CPC ..... *F01D 5/187* (2013.01); *F05D 2230/21* (2013.01); *F05D 2230/211* (2013.01); *F05D 2240/305* (2013.01); *F05D 2300/20* (2013.01)

(58) Field of Classification Search
CPC . B22C 9/10; F05D 2230/21; F05D 2230/211; F05D 2240/305; F05D 2240/306; F05D 2240/307; F05D 2300/20
See application file for complete search history.

(56) References Cited

U.S. PATENT DOCUMENTS 4,596,281 A * 6/1986 Bishop ..... B22C 9/10 164/122.1
4,627,480 A * 12/1986 Lee ..... B22C 9/04 164/122.1
5,296,308 A * 3/1994 Caccavale ..... B22C 9/04 164/361
5,599,166 A * 2/1997 Deptowicz ..... B22C 9/04 164/369
5,702,232 A * 12/1997 Moore ..... F01D 5/186 416/95
5,720,431 A 2/1998 Sellers et al.
5,820,774 A * 10/1998 Dietrich ..... B22C 9/10 249/61
5,947,181 A * 9/1999 Davis ..... B22C 9/106 164/131
6,511,293 B2 * 1/2003 Widrig ..... F01D 5/187 415/115
6,773,230 B2 * 8/2004 Bather ..... F01D 5/186 415/115
6,915,840 B2 * 7/2005 Devine, II ..... B22C 9/04 164/137
6,929,054 B2 * 8/2005 Beals ..... B22C 7/02 164/365
6,966,756 B2 * 11/2005 McGrath ..... F01D 5/187 416/96 R
7,377,746 B2 * 5/2008 Brassfield ..... B22C 9/043 29/888.024
7,413,403 B2 * 8/2008 Cunha ..... B22C 9/10 164/369
7,674,093 B2 * 3/2010 Lee ..... B22C 9/103 164/365
7,722,324 B2 * 5/2010 Cunha ..... F01D 5/187 416/97 R
2003/0075300 A1 4/2003 Shah et al.
2004/0020629 A1 2/2004 Shah et al.
2005/0258577 A1 * 11/2005 Holowczak ..... B28B 7/0014 264/600
2006/0249275 A1 * 11/2006 Judet ..... B22C 9/04 164/516
2008/0056908 A1 * 3/2008 Morris ..... F01D 5/187 416/97 R
2008/0251979 A1 10/2008 Louesdon et al.
2010/0034662 A1 * 2/2010 Jendrix ..... B22C 9/10 416/97 R
2014/0271225 A1 9/2014 Herzlinger et al.
2015/0132139 A1 * 5/2015 Tran ..... B22C 9/04 416/223 A
2017/0183969 A1 * 6/2017 Dujol ..... B22C 9/103
2017/0183970 A1 * 6/2017 Dujol ..... B22C 9/103

FOREIGN PATENT DOCUMENTS

FR 2 569 225 A1 2/1986
JP 11-287103 A 10/1999
JP 2008-151112 A 7/2008
JP 2014-196735 A 10/2014
RU 2 461 439 C2 9/2012

OTHER PUBLICATIONS

Russian Search Report dated Sep. 12, 2019, in Patent Application No. 2017134365/06, 3 pages (with English Translation of Category of Cited Documents).
Japanese Office Action dated Feb. 25, 2020, in Patent Application No. 2017-549652, 6 pages (with English translation).

* cited by examiner

CERAMIC CORE FOR A MULTI-CAVITY TURBINE BLADE

FIELD OF THE INVENTION

The present invention relates to the general field of sets of blades for a turbine engine turbine, and more particularly to turbine blades having cooling circuits incorporated therein and made by the lost-wax casting technique.

PRIOR ART

In known manner, a turbine engine includes a combustion chamber in which air and fuel are mixed together prior to being burnt therein. The gas resulting from such combustion flows downstream from the combustion chamber and then feeds a high-pressure turbine and a low-pressure turbine. Each turbine comprises one or more stationary vane rows (known as nozzles) alternating with one or more moving blade rows (referred to as rotor wheels), in which rows the blades or vanes are spaced apart circumferentially all around the rotor of the turbine. Such turbine blades or vanes are subjected to the very high temperatures of the combustion gas, which temperatures reach values that are well above those that can be withstood without damage by the blades or vanes that are in direct contact with the gas, thereby having the consequence of limiting their lifetimes.

In order to solve this problem, it is known to provide such blades and vanes with internal cooling circuits presenting high levels of thermal effectiveness and seeking to reduce their temperatures by creating an organized flow of the air inside each blade or vane (e.g. simple direct feed cavities U-shaped or "trombone" cavities) together with perforations in the wall of the blade or vane for generating a protective film around it.

Nevertheless, that technology presents several drawbacks. Firstly, although circuits with trombone cavities present the advantage of maximizing the work done by the air passing through the circuit, that leads to considerable heating of the air, which results in a reduction in the thermal effectiveness of the holes situated at the end of the trombone cavity. In the same manner, configurations having leading edge cavities and trailing edge cavities with direct feed do not make it possible to provide an effective response at the high temperature levels usually observed at the tip of a blade. Finally, the various cavities are separated from the gas flow passage only by a wall of thickness that varies as a function of different zones of the airfoil. Given the constraints on the flow rate that can be devoted to cooling sets of blades or vanes, and given the current trend towards increasing temperatures in the gas passage, it is not possible to cool a blade or a vane effectively with a circuit of that type without significantly increasing the flow rate of the air, and thus penalizing the performance of the engine.

FIG. 5 shows a high-pressure turbine blade 10 of a gas turbine engine having an aerodynamic surface or airfoil 12 that extends in a radial direction between a blade root 14 and a blade tip 16. The root of the blade is shaped in such a manner as to enable the blade to be mounted on a rotor disk. The blade tip presents a portion 18 of bathtub shape constituted by a bottom extending transversely relative to the airfoil and by a wall forming its edge that extends the wall of the airfoil 12. As shown in the section view of FIG. 6, given as an example merely to show principles, the airfoil 12 has a plurality of cavities 20, 22, 24, 26, 28, 30, and 32. First and second central cavities 20 and 22 extend from the root to the tip of the airfoil and two other cavities 24 and 26 are arranged on either side of the central cavities along the suction side wall between the central cavities and the suction side wall of the blade, and along the pressure side wall between the central cavities and the pressure side wall of the blade. Finally, a cavity 28 is situated in the portion of the blade close to the leading edge, and two cavities 30 and 32 follow one another in line in the portion of the blade close to the trailing edge.

The shape and the number of cavities, and also the positions of the external holes 34, 36 and the shapes of the trailing edge slots 38 are shown by way of illustration, given that all of these elements are generally optimized so as to maximize thermal efficiency in the zones that are the most sensitive to the heat from the combustion gas in which the blades are immersed. The internal cavities are also often provided with turbulators (not shown) in order to increase heat exchange.

As described in application FR 2 961 552 in the name of the Applicant, high-pressure turbine blades and vanes are conventionally made by lost-wax casting, with the shapes of the circuits being made therein by positioning one or more ceramic cores (depending on complexity) in the mold and presenting outside surfaces that form the inside surfaces of the finished blade or vane.

In particular, the cooling circuits have a plurality of cavities, like those in FIGS. 5 and 6, that require a plurality of separate ceramic cores to be assembled together (for making the cold central cavities that are isolated from the hot gas and the fine outer cavities that have distinct air feeds) in order to guarantee metal wall thicknesses that are suitable for being cast. This thus constitutes an operation that is complex, in which the assembly operation, which is performed manually via the roots and the tips of the ceramic cores, prevents the bathtub at the tip of the blade being made by casting, thereby requiring an expensive additional finishing operation that might possibly lead to limiting the mechanical strength of the blade in that zone (adding the bathtub or plugging by brazing, for example).

OBJECT AND SUMMARY OF THE INVENTION

The present invention thus seeks to mitigate the drawbacks associated with manually assembling a plurality of separate cores by proposing a cooling circuit for a turbine blade that can be made using a single core so as to eliminate those assembly operations and bathtub finishing operations required by prior art circuits, while also guaranteeing an intercavity distance, corresponding to the thickness of the metal partition after casting the molten metal, in a manner that is more reliable than with present manual assemblies.

To this end, there is provided a ceramic core used for fabricating a hollow turbine blade for a turbine engine by using the lost-wax casting technique, the blade including at least one central cavity, a first lateral cavity arranged between said at least one central cavity and a suction side wall of the blade, and a second lateral cavity arranged between said at least one central cavity and a pressure side wall of the blade. The core is shaped to constitute said cavities as a single element and, in order to feed the insides of said cavities jointly with cooling air, it includes core portions that are to form said first and second lateral cavities and that are connected to a core portion that is to form said at least one central cavity, firstly in the core root via at least two ceramic junctions, and secondly at various heights up said core via a plurality of other ceramic junctions of position that defines the thickness of the internal partitions of the blade, while also ensuring additional cooling air for predetermined critical zones of said first and second lateral cavities.

In addition, a core portion for forming a bathtub and connected to said core portion that is to form at least one central cavity via ceramic junctions of positioning that defines the thickness of said bathtub, while ensuring that cooling air is discharged at the blade tip.

By means of these junctions via the body of the blade, the need for assembly contrivances at the blade tip is eliminated, thereby making it possible to obtain a cast bathtub having the same mechanical properties as the body of the blade. In addition, the main feed of the lateral cavities via their roots gives better control over the air stream and over the overall cooling of the outer walls of the finished airfoil, and in the core, the feeds to the various cavities can be joined as from injection, thereby further improving the mechanical strength of the cores.

In the intended embodiment, said predetermined critical zones are selected from the zones of said first and second lateral cavities that are subjected to the greatest thermomechanical stresses, and said ceramic junctions are of section determined to ensure the mechanical strength of said internal partitions while casting the molten metal.

The invention also provides both the method of fabricating a hollow turbine blade for a turbine engine using the lost-wax casting technique with a single-element core as explained above, and also any turbine engine turbine including a plurality of cooled blades fabricated using such a method.

BRIEF DESCRIPTION OF THE DRAWINGS

Other characteristics and advantages of the present invention appear from the following description made with reference to the accompanying drawings, which show an implementation having no limiting character, and in which.

DETAILED DESCRIPTION OF AN EMBODIMENT

Figure 2:
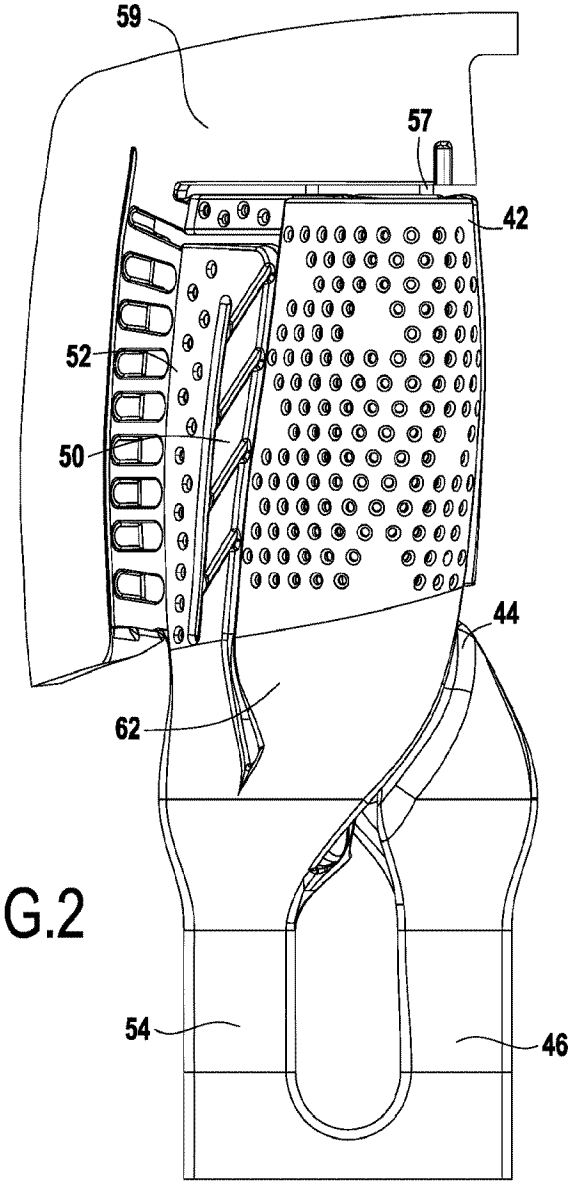
FIG. 2 is a pressure side view of a turbine blade core of the invention.
Figure 1:
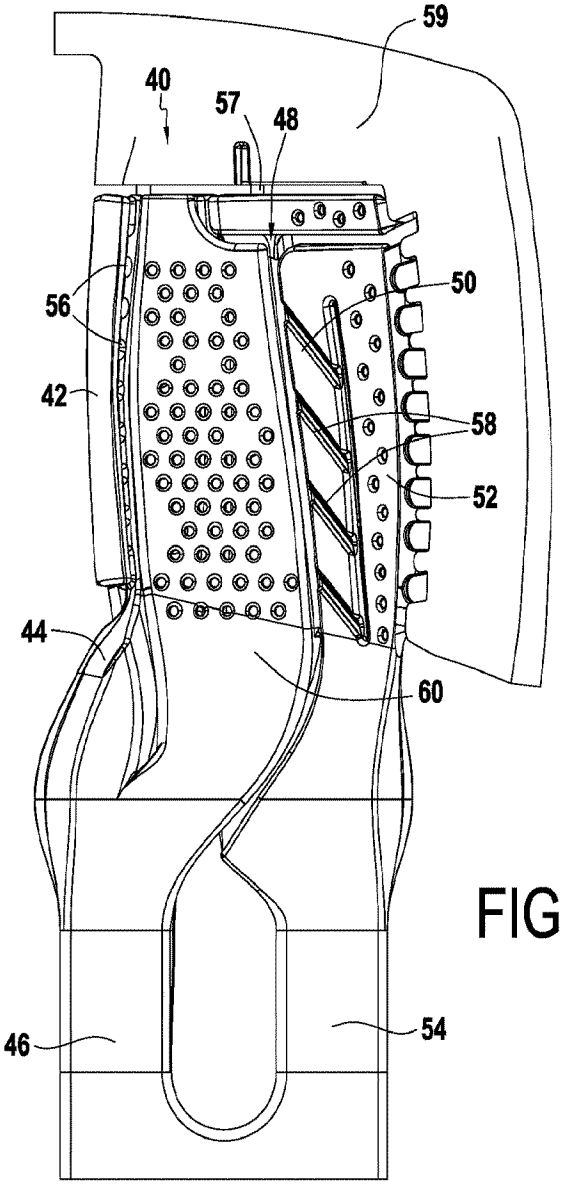
FIG. 1 is a pressure side view of a turbine blade core of the invention.

FIGS. 1 and 2 show a ceramic core 40 for making a turbine blade for a turbine engine, respectively in a suction side view and in a pressure side view relative to the blade. The ceramic core, in the example shown, comprises seven portions or columns forming a single element. The first column 42, which is to be located on the side where the combustion gas arrives, corresponds to the leading edge cavity 28 that is to be created after casting, whereas the second column 44 corresponds to the central cavity 20, which is adjacent thereto. This cavity receives a stream of cooling air via a channel (not shown) that results, after casting, from the presence of a first column root 46 of the core 40. The other three columns 48, 50, and 52 follow go-and-return paths and correspond to the following cavities 22, 30, and 32, which receive a second cooling air stream conveyed by another channel resulting from the presence of a second column root 54 connected to the first column root 46 in order to form the root of the core. The first and second columns 42 and 44 are connected together by a series of bridges 56 that correspond, after casting, to feed orifices (see reference 80 in FIG. 4A) for cooling the leading edge cavity 28. At least two top bridges 57, at the connection with the columns and a tip 59 of the core 40 make it possible to obtain the desired thickness for the partition at the bottom of the bathtub during casting and are also dimensioned so as to form air discharge orifices. Concerning the fourth column 50, vertically inclined small bridges 58 create thinner regions of the core enabling stiffened regions of the blade to be created.

The sizes of the various bridges are determined so as to avoid them breaking while the core 40 is being handled, which could make it unusable. In the example under consideration, the bridges are distributed by being spaced apart substantially regularly up the height of the core 40, and in particular in the first column 42 of the core.

Figure 3:
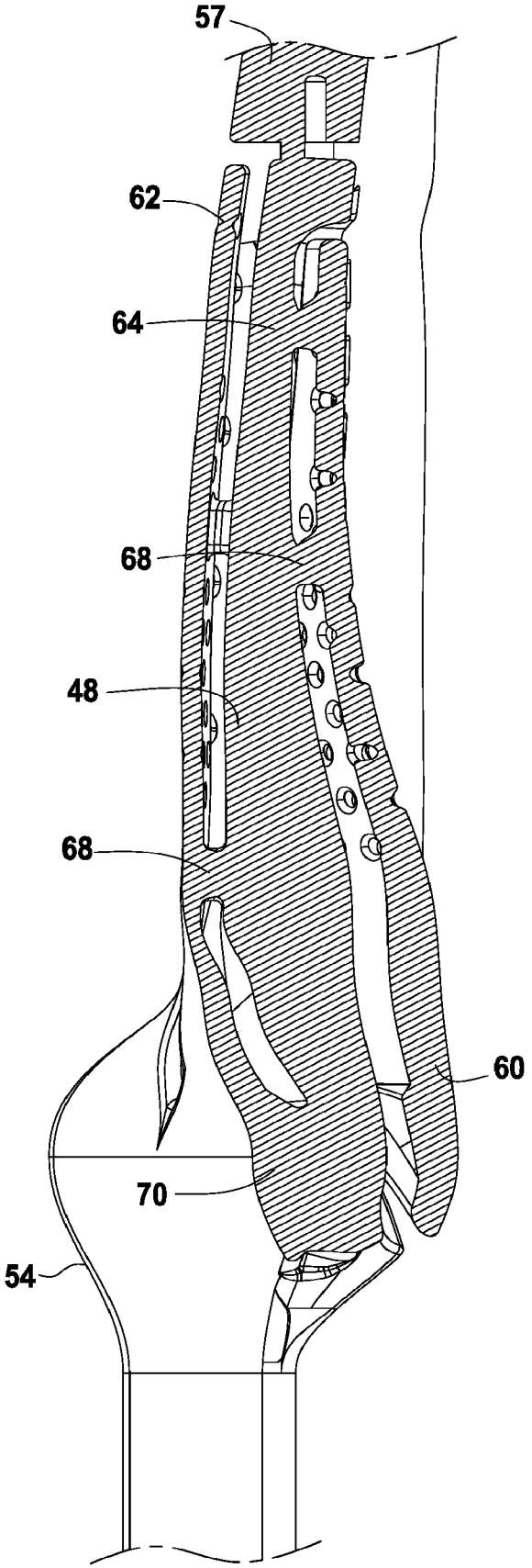
FIG. 3 is a view of the core of FIGS. 1 and 2 in section on the height of the blade for showing its junction zones.

In accordance with the invention, the core 40 also has sixth and seventh columns 60 and 62 arranged laterally and both spaced apart from the second and third columns 44 and 48 by determined spacing so as to leave room for creating a solid inter-cavity wall when casting molten metal. For purposes of holding these columns and imparting rigidity to the core assembly, the bottom end of the sixth column 60 is connected to the first column root 46, and the bottom end of the seventh column 62 is connected to the second column root 54, and multiple ceramic junctions of small section (see for example references 64, 66, 68 in FIG. 3) of dimensions that are nevertheless sufficient for providing mechanical strength for the internal partitions that are formed while casing molten metal into the casing mold are themselves arranged on the functional portion of the blade between the two lateral columns and the central second and third columns.

The presence of two column root connections (even through only the ceramic junction 70 at the root of the seventh column 62 is shown) has the consequence, after casting, that the lateral cavities 24, 26 are connected directly to the cooling air feed channel of the central cavities 20 and 22, thereby further improving the mechanical strength of the core and, in the finished airfoil, improving the feed via the root of the core so as to obtain better control over the internal stream of cooling air and over the overall cooling of the outer walls.

Figure 4A:
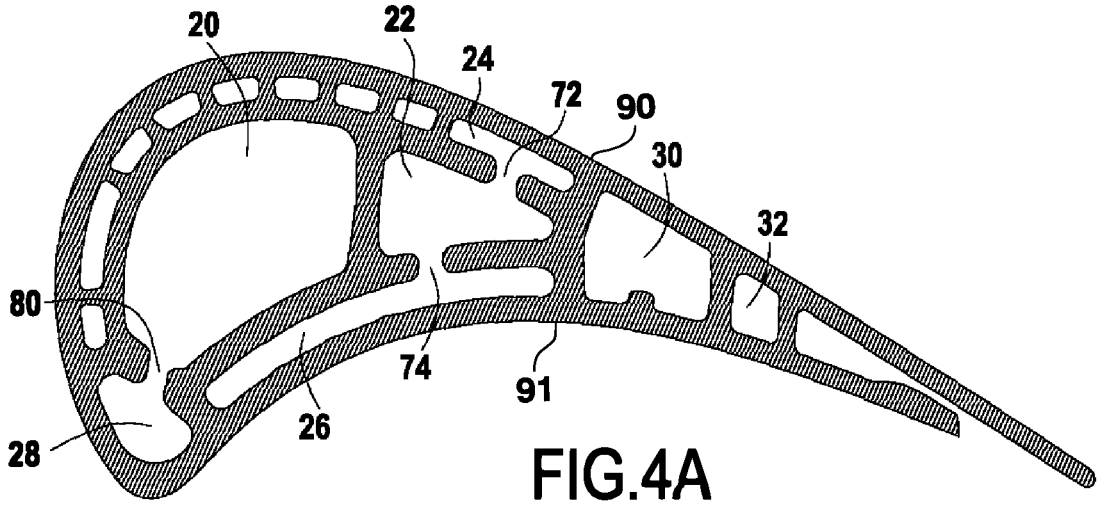
FIGS. 4A, 4B, and 4C are section views at different heights up the blade.
Figure 4B:
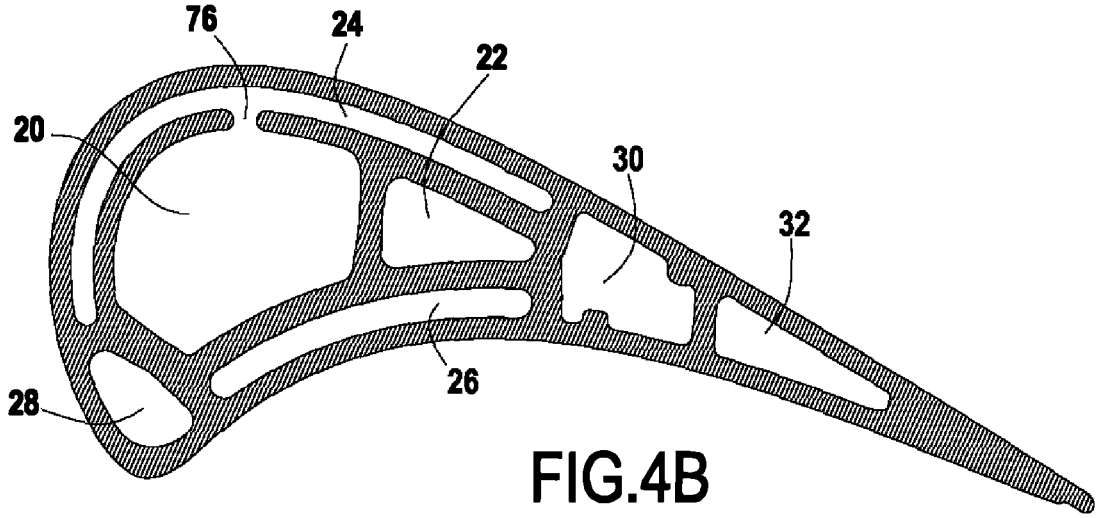
Figure 4C:
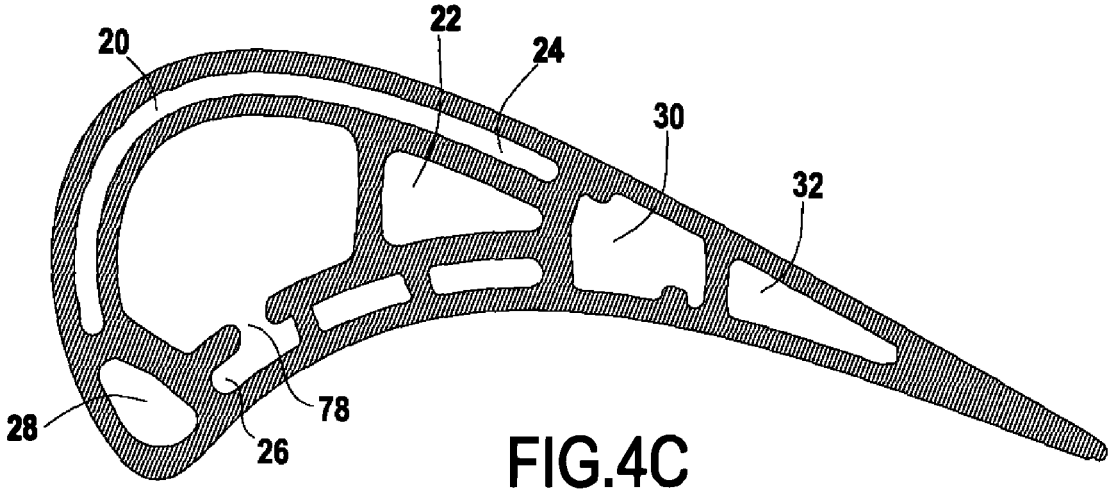
Figure 5:
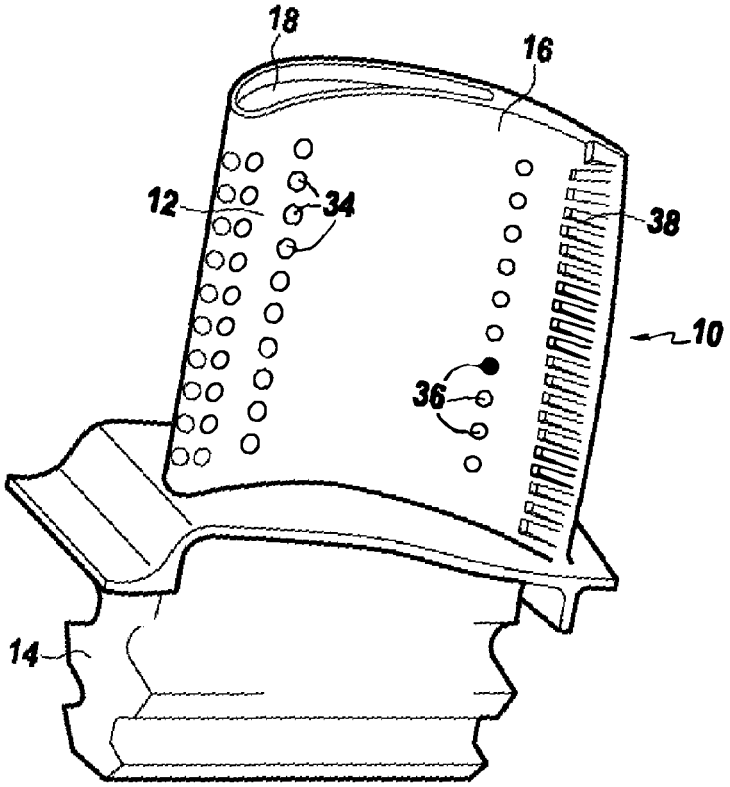
FIG.5 PRIOR ART
FIG. 5 is a perspective view of a prior art turbine blade.
Figure 6:
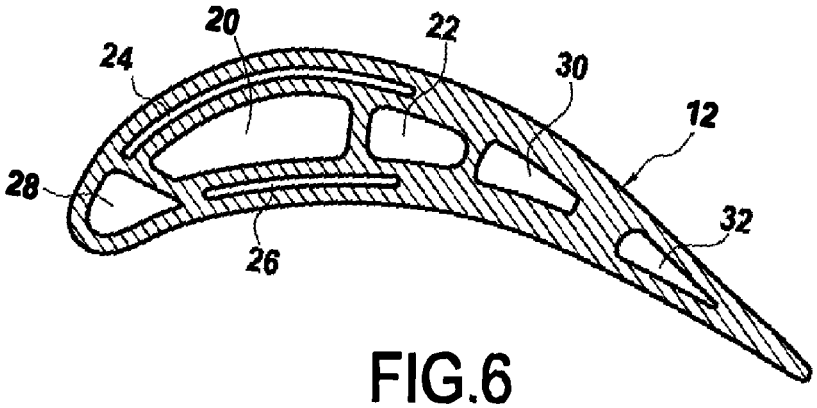
FIG.6 PRIOR ART
FIG. 6 is a section view of the FIG. 5 blade.

FIGS. 4A, 4B, and 4C show suction side wall 90, pressure side wall 91, the orifices 72, 74, 76 and 78 left by the junctions between the two central cavities 20, 22 and the two lateral cavities 24, 26 at different heights up the blade (or up the core).

In FIG. 4A, there can be seen two orifices 72 and 74 providing an air passage between the central cavity 22 and the respective lateral cavities 24 and 26, the orifice 80 level with the leading edge cavity 28 resulting from a bridge 56. In FIG. 4B, the orifice 76 provides an air passage between the central cavity 20 and the lateral cavity 24, and in FIG. 4C, the orifice 78 provides an air passage between the central cavity 20 and the lateral cavity 26.

Once the single-element core has been made, the lost-wax method of fabricating the blade is conventional and consists initially in forming an injection mold in which the core is placed prior to injecting wax. The wax model as created in that way is then dipped in slurries constituted by ceramic suspensions in order to make a casting mold (also known as a shell mold). Finally, the wax is eliminated, and the shell mold is baked so that molten metal can then be cast into it.

Because of the ceramic junctions interconnecting the central columns and the lateral columns of the core, their relative spacing is controlled over the entire height of the blade. These junctions are also positioned in such a manner as to give rise, in the finished blade, to an additional supply of cool air from the central cavities towards the zones of the lateral cavities that are subjected to the greatest thermomechanical stresses, thereby also improving local thermal efficiency and the lifetime of the blade. In particular, these junctions are dimensioned and arranged in such a manner as to ensure:

mechanical strength during casting;

relative positioning of the central and lateral cavities, i.e. the thickness of the internal partitions in the blade; and sufficient additional cooling air in the critical zones, in particular corresponding to proximity with the leading edge.

The invention claimed is:

1. A ceramic core used for fabricating a hollow turbine blade for a turbine engine by using a lost-wax casting technique, the core comprising:

leading and trailing edge cavities;

at least one central cavity;

a first lateral cavity arranged between said at least one central cavity and a suction side wall of the blade; and a second lateral cavity arranged between said at least one central cavity and a pressure side wall of the blade, wherein the core is shaped to constitute all said cavities as a single element, wherein to feed an inside of each of said leading and trailing edge cavities, first lateral cavity, second lateral cavity and at least one central cavity jointly with cooling air, the core includes first and second core portions that respectively form said first and second lateral cavities and that are connected to a third core portion that forms said leading and trailing edge cavities and said at least one central cavity, firstly in a core root via at least two core root ceramic junctions, and secondly at various heights along a height of said core via a plurality of core height ceramic junctions positioned to define a thickness of internal partitions of the blade, while also ensuring additional cooling air for predetermined critical zones of said first and second lateral cavities.

2. The ceramic core according to claim 1, further including a fourth core portion for forming a bathtub and connected to said third core portion that is to form at least one central cavity via blade tip ceramic junctions positioned to define a thickness of said bathtub, while ensuring that cooling air is discharged at a blade tip.

3. The ceramic core according to claim 1, wherein said predetermined critical zones are zones of said first and second lateral cavities that are subjected to the greatest thermomechanical stresses.

4. The ceramic core according to claim 1, wherein said core height ceramic junctions are of section determined so as to ensure the mechanical strength of said internal partitions while casting the molten metal.

5. The use of a ceramic core according to claim 1, for fabricating a hollow turbine blade for a turbine engine using the lost-wax casting technique.

6. A fabrication method for fabricating a hollow turbine blade for a turbine engine by using a lost-wax casting technique, the blade including leading and trailing edge cavities at least one central cavity, a first lateral cavity arranged between said at least one central cavity and a suction side wall of the blade, and a second lateral cavity arranged between said at least one central cavity and a pressure side wall of the blade, the method comprising:

fabricating a single-element ceramic core corresponding to said leading and trailing edge cavities, to said at least one central cavity and to said first and second lateral cavities, first and second core portions that are to respectively form said first and second lateral cavities are connected to a third core portion that forms said leading and trailing edge cavities and said at least one central cavity, firstly in a core root via at least two core root ceramic junctions so as to feed insides of said cavities jointly with cooling air, and secondly at various heights along a height of said core via a plurality of core height ceramic junctions positioned to define a thickness of internal partitions of the blade, while ensuring additional cooling air for predetermined critical zones of said first and second lateral cavities;

placing the ceramic core into place in a casting mold; and casting molten metal in said casting mold.

7. The fabrication method according to claim 6, wherein said single-element ceramic core further includes a fourth core portion for forming a bathtub and connected to said third core portion that is to form the at least one central cavity via blade tip ceramic junctions of positioned to define a thickness of said bathtub, while ensuring that cooling air is discharged at a blade tip.

8. The turbine engine including the hollow turbine blade fabricated using the fabrication method of claim 6.

* * * * *